United States Patent [19]

Taylor

[11] 4,261,604

[45] Apr. 14, 1981

[54] LOCK ASSEMBLY

[76] Inventor: Edward Taylor, Box 487, Snow Lake, Manitoba, Canada

[21] Appl. No.: 51,020

[22] Filed: Jun. 22, 1979

[51] Int. Cl.[3] ..... E05C 3/26

[52] U.S. Cl. ..... 292/216

[58] Field of Search ..... 292/216, 213, 218, DIG. 41

[56] References Cited

U.S. PATENT DOCUMENTS

| | | | |
|---|---|---|---|
| 1,544,960 | 7/1925 | Watts | 292/216 |
| 2,376,102 | 5/1945 | Voight et al. | 292/216 X |
| 2,458,751 | 1/1949 | Voight | 292/DIG. 41 |
| 2,889,164 | 6/1959 | Clark | 292/216 X |
| 3,912,311 | 10/1975 | Carvell et al. | 292/216 |

*Primary Examiner*—Richard E. Moore

*Attorney, Agent, or Firm*—Stanley G. Ade

[57] ABSTRACT

The lock assembly includes a conventional inner bolt portion movable endwise by either a key or door knob in the usual way. The end of the bolt portion within the door is provided with a ratchet and the other bolt portion is correspondingly ratcheted. The other bolt portion is partially rotatable and includes the locking portion on the distal end thereof situated on the outside of the door. This locking portion is cylindrical and has an inwardly stepped lock plate engaging wall and a developed curve extending from the inner end of the step to the outer perimeter so that as it rolls along a sloping ramp in the keeper plate, the other part of the bolt partially rotates with the step engaging behind the keeper plate and the other bolt portion rotating about the longitudinal axis thereof with the ratchet preventing reverse rotation of the other portion of the bolt until the inner bolt portion is moved endwise by the key or knob thus disengaging the ratchet and allowing the other bolt portion to reverse its rotational movement and roll out of engagement with the lock plate as the door is opened.

8 Claims, 12 Drawing Figures

LOCK ASSEMBLY

BACKGROUND OF THE INVENTION

This invention relates to new and useful improvements in lock assemblies. The integrity of conventional self-latching or self-locking lock assemblies is easily breached either by sliding a flexible sheet against the curved portion of the latch or by spreading the door jamb from the door edge with a crowbar or the like. These are the two main methods of forcing a lock and it is therefore normal to provide an additional dead bolt on the door for extra security.

However, dead bolts require separate keys and a separate opening and closing action and furthermore, they are not self-locking when the door is closed.

Attempts have been made in the past to overcome these disadvantages and prior art known to the applicant includes the following patents:

U.S. Pat. No. 2,136,408
U.S. Pat. No. 2,217,098
U.S. Pat. No. 2,344,532
U.S. Pat. No. 2,889,164
U.S. Pat. No. 3,116,082
U.S. Pat. No. 3,691,799

However, all of these suffer from several disadvantages inasmuch as they are sometimes easily breached and where not easily breachable, are relatively involved so that they become expensive to construct.

Furthermore, none of them are adaptable for use with a conventional locking set but have to be manufactured in their entirety.

SUMMARY OF THE INVENTION

The present invention overcomes these disadvantages by providing a lock assembly which can either be manufactured in its entirety or, alternatively, can readily be adapted to existing lock sets merely by replacing the bolt and the striker plate.

In accordance with the invention there is provided a lock assembly for doors and the like comprising in combination support means, an inner bolt portion lengthwise movable within said support means, by conventional means such as a key or door knob, an outer bolt portion partially rotatable within said support means and movable from a locked position to an unlocked position and vice-versa, means preventing endwise movement of said outer bolt portion, and a keeper plate assembly cooperating with said outer bolt portion to latch and lock said outer bolt portion against rotation thereof when in said locked position and means cooperating between said inner and outer bolt portions preventing rotation of said outer bolt portion from said locked position, towards said unlocked position when said inner bolt portion is endwise engaged with the inner end of said outer bolt portion.

Another advantage of the present invention is to provide a device of the character herewithin described in which spreading can be reduced or eliminated merely by increasing the thickness of the locking portion of the outer bolt assembly which engages the striker plate.

Another advantage of the invention in conjunction with the foregoing advantages is to provide a striker plate with an end cap thus making spreading extremely difficult to initiate.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts of the different figures.

DETAILED DESCRIPTION

Figure 1:
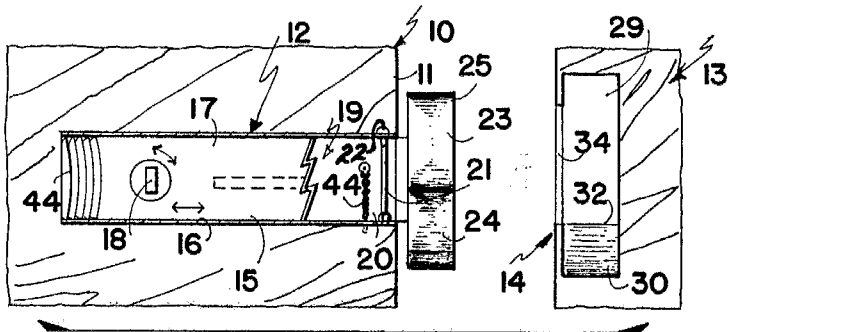
FIG. 1 is a fragmentary partially sectioned view of the edge of a door with the bolt assembly incorporated therein and a fragmentary portion of the door jamb spaced from the door edge for clarity and including the striker plate assembly.

Proceeding therefore to describe the invention in detail, reference should first be made to FIG. 1 in which reference character 10 illustrates a portion of a door with 11 being the vertical free edge thereof containing a lock bolt assembly collectively designated 12.

Reference character 13 shows a portion of a door jamb containing a lock plate assembly collectively designated 14.

The lock assembly 12 normally contains support means such as cylindrical sleeve 15 which is frictionally engaged the cylindrical aperture 16 formed into the door from the free vertical edge 11.

The lock assembly includes a cylindrical inner bolt portion 17 journalled for limited endwise movement within the sleeve 15 and operated by the conventional engagement of a key or knob through a slot 18. As this is conventional, it is not believed necessary to describe same further.

An outer bolt portion is provided collectively designated 19, said outer bolt portion also including a cylindrical portion 20 mounted within sleeve 15 and including means to prevent endwise movement. In the present embodiment, an annular groove 21 is formed around the cylindrical portion 20, engageable by a pin 22 extending through the wall of the sleeve 15 and engaging the groove. This permits rotation of this outer bolt portion 19 but prevents endwise movement thereof.

A cylindrical bolt 23 is formed on the outer end of the outer bolt portion exteriorly of the door 10.

This cylindrical portion includes a lock plate engaging step 24 extending from the perimeter 25 of the cylindrical portion 23, radially inwardly to a point 26 spaced from the axis 27. A compound curved perimetrical portion 28 extends from the inner end 26 of the step, to the circumferential perimeter 25 of the cylindrical portion, said compound curved portion extending approximately through 90°.

The striker plate assembly 14 includes the recessed portion 29 formed in the door jamb 13 and having an inclined ramp 30 extending from the outer edge 31 of the jamb upwardly and inwardly to the inner end 32 thereof whereupon the inner end meets a vertical wall 33 which extends downwardly to the base of the recess 29. This vertical wall 33 is engaged by the step 24 when the door is in the closed position as will hereinafter be described.

A cover plate 34 is preferably provided on the outer surface 35 of the door jamb to cover the vertical wall 33 and to prevent or to make more difficult, any spreading between the door and the door jamb.

The sloping ramp or incline 30 is at an angle which will permit the compound curve of the cylindrical portion 23 to roll along the ramp thereby rotating the outer bolt portion until the step engages over the vertical wall 33, it being understood that the axis 27 of the outer bolt portion remains in alignment with the axis of the inner bolt portion 17.

Means are provided to prevent the reverse movement of the outer bolt portion by pulling on the door unless the inner bolt portion 17 is moved endwise by the key or door knob (not illustrated) in the usual way, said means taking the form of a ratchet assembly formed on the adjacent ends of the inner bolt portion 17 and the outer bolt portion 19.

In the present embodiment, a segment 36 is cut away from the end 37 of the inner bolt portion 17 and a segment 38 is formed on the inner end 39 of the outer bolt portion 19, said segment 38 extending from the end 39.

The dimensions of the cut-away section 36 and the projecting segment 38 are such that the outer bolt portion can rotate approximately 90° relative to the inner bolt portion, the limits of rotation being defined by the engagement of the segment 38 with the wall of the cut-away segment 36.

Figure 2:
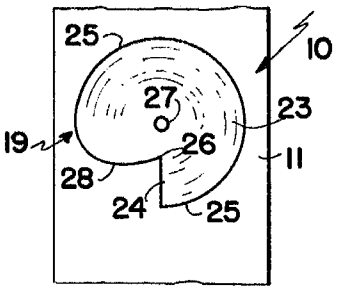
FIG. 2 is an end view of the door portion of FIG. 1 showing the bolt in the locked position.
Figure 3:
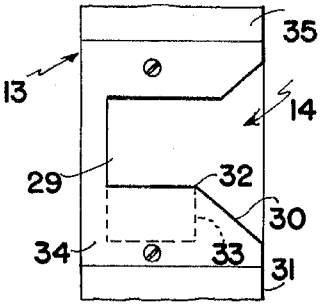
FIG. 3 is an end view of the door jamb portion of FIG. 1 showing the striker plate assembly.
Figure 5:
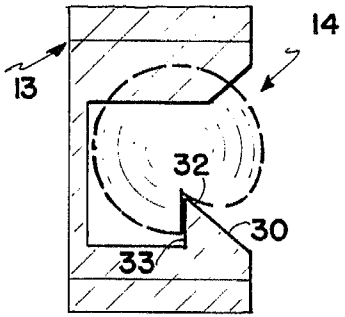
FIG. 5 is a vertical section of FIG. 3 showing the interior of the striker plate assembly.
Figure 6:
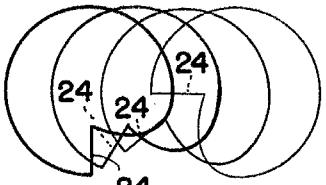
FIG. 6 is a schematic view showing the compound curve and slope of the striker plate.
Figure 12:
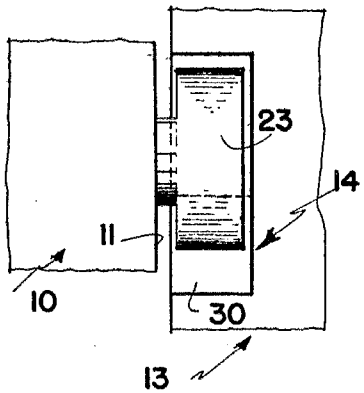
FIG. 12 is a view similar to FIG. 1, but showing the door in the closed and locked position, relative to the door jamb.
Figure 10:
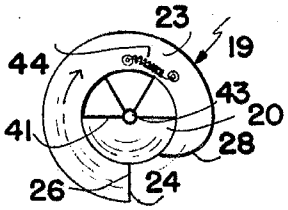
FIG. 10 is a view similar to FIG. 9, but showing the bolt in the locked position.
Figure 11:
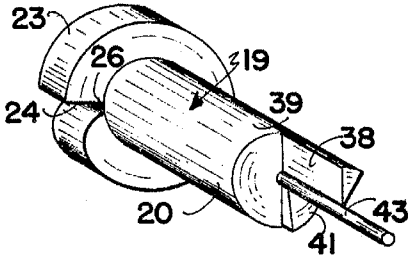
FIG. 11 is an isometric view of FIG. 9.
Figure 7:
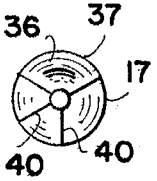
FIG. 7 is an end view of the inner bolt portion per se.
Figure 8:
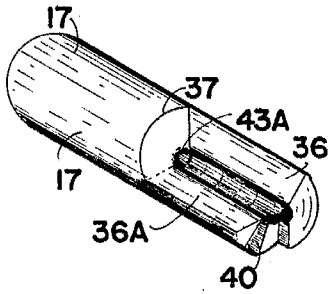
FIG. 8 is an isometric view of FIG. 7.
Figure 9:
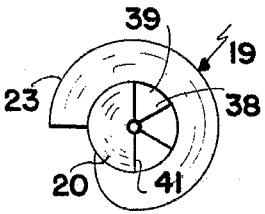
FIG. 9 is an end view of the outer bolt portion per se, shown in the unlocked position.

Ratchet teeth 40 are formed on the end of the inner bolt portion 17 and corresponding ratchet teeth 41 are formed on the inner end 39 of the outer bolt portion 19, said ratchet teeth cooperating together to permit the outer bolt portion to rotate only in the direction of arrow 42. In other words, the ratchet teeth permit rotation of the cylindrical portion 23 from the unlocked position shown in FIG. 5, to the locked position shown in FIG. 2, but prevent rotation in the opposite direction so that once the step 24 is engaged over the vertical wall 33, it is impossible to open the door unless the inner bolt portion 17 is withdrawn lengthwise so that the ratchet teeth disengage.

It is desirable that a mounting pin 43 extends from the axis of the end 39 of the outer bolt portion engageable within a corresponding axial drilling 43A in the inner bolt portion to give additional support for the bolt portions.

Figure 4:
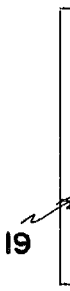
FIG. 4 is a view similar to FIG. 2, but showing the bolt in the unlocked position.

A small tension spring 44 or the like, is connected by one end thereof to the outer bolt portion 19 and by the other end thereof to the support cylinder 15, said tension spring normally urging the outer bolt portion to the unlocked position shown in FIG. 4.

In operation, the cylindrical portion 23 is normally in the unlocked position shown in FIG. 4, urged into this position by means of tension spring 44 and the projecting segment portion 38 of the outer bolt portion is engaged against one wall 36A of the cut-away segment 36 of the inner bolt portion.

As the door is moved towards the closed position, the compound curved perimetrical portion 28 engages the sloping or inclined ramp 30 of the striker plate assembly 14 and is forced to roll along this ramp thereby rotating the outer bolt portion and engaging the step 24 with the inner vertical wall 33 of the striker plate assembly. At the same time, the ratchet teeth 40 and 41 ride over one another and engage in order to prevent the outer bolt portion from rotating in the opposite direction.

The door is therefore firmly locked until the inner bolt portion 17 is moved endwise away from the outer bolt portion 19 thus permitting the tension spring 34 to apply rotational tension to the outer bolt portion so that as the door is pulled open, the cylindrical portion 23 rolls down the ramp thereby disengaging the step 24 from the vertical wall 33.

The inner bolt portion 17 is normally provided with a spring 44 normally urging it towards the vertical edge 11 of the door against which it may be moved by the key or knob, when rotated, or by the riding of the ratchet teeth 41 over the ratchet teeth 40.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A lock assembly for doors and the like comprising in combination support means, an inner bolt portion lengthwise movable within said support means, by conventional means such as a key or door knob, an outer bolt portion partially rotatable within said support means and movable from a locked position to an unlocked position and vice versa, means preventing endwise movement of said outer bolt portion, and a keeper plate assembly cooperating with said outer bolt portion to latch and lock said outer bolt portion against rotation thereof when said locked position and means cooperating between said inner and outer bolt portions preventing rotation of said outer bolt portion from said locked position, towards said unlocked position when said inner bolt portion is endwise engaged with the inner end of said outer bolt portion, said outer bolt including a substantially cylindrical end portion situated externally of the associated door, said cylindrical portion including a locking step extending substantially radially from the perimeter of said cylindrical portion towards the axis thereof, an inclined ramp on said striker plate and a compound curved perimetrical portion on said cylindrical portion extending from the inner end of said locking step to the circumferential perimeter of said cylindrical portion through approximately 90°, the radius of curvature of said compound curve increasing from said inner end of said locking step, said compound curve rolling along said inclined ramp as said outer bolt portion partially rotates when moving from the unlocked position towards the locked position, the axis of said outer bolt portion remaining in alignment with the axis of said inner bolt portion.

2. The invention according to claim 1 which includes means cooperating between said outer bolt portion and said keeper plate to move said outer bolt portion into said locked position relative to said keeper plate, when said outer bolt portion engages said keeper plate.

3. The device according to claim 1 in which said striker plate includes locking step engaging means at the inner end of said inclined ramp.

4. The device according to claim 1 in which said means cooperating between said inner and outer bolt portions includes a cut-out segment on the adjacent end of one of said bolt portions and a corresponding projecting segment formed on the adjacent end of the other of said bolt portions, said segments engaging one within the other and limiting the movement of said outer bolt portion from the unlocked position to the locked position and vice-versa and permitting said outer bolt portion to partially rotate through approximately 90°, at least one ratchet tooth on one of said bolt portions, means engaged by said ratchet tooth on the other of said bolt portions, said ratchet tooth and said last mentioned means permitting rotation of said outer bolt portion to the locked position but preventing movement of said outer bolt portion towards the unlocked position when said bolt portions are endwise engaged and permitting rotation of said outer bolt portion to the unlocked position when said ratchet tooth is disengaged from said last mentioned means, by endwise movement of said inner bolt portion by said associated key or door knob as aforesaid.

5. The device according to claim 2 in which said means cooperating between said inner and outer bolt portions includes a cut-out segment on the adjacent end of one of said bolt portions and a corresponding projecting segment formed on the adjacent end of the other of said bolt portions, said segments engaging one within the other and limiting the movement of said outer bolt portion from the unlocked position to the locked position and vice-versa and permitting said outer bolt portion to partially rotate through approximately 90°, at least one ratchet tooth on one of said bolt portions, means engaged by said ratchet tooth on the other of said bolt portions, said ratchet tooth and said last mentioned means permitting rotation of said outer bolt portion to the locked position but preventing movement of said outer bolt portion towards the unlocked position when said bolt portions are endwise engaged and permitting rotation of said outer bolt portion to the unlocked position when said ratchet tooth is disengaged from said last mentioned means, by endwise movement of said inner bolt portion by said associated key or door knob as aforesaid.

6. The device according to claim 3 in which said means cooperating between said inner and outer bolt portions includes a cut-out segment on the adjacent end of one of said bolt portions and a corresponding projecting segment formed on the adjacent end of the other of said bolt portions, said segments engaging one within the other and limiting the movement of said outer bolt portion from the unlocked position to the locked position and vice-versa and permitting said outer bolt portion to partially rotate through approximately 90°, at least one ratchet tooth on one of said bolt portions, means engaged by said ratchet tooth on the other of said bolt portions, said ratchet tooth and said last mentioned means permitting rotation of said outer bolt portion to the locked position but preventing movement of said outer bolt portion towards the unlocked position when said bolt portions are endwise engaged and permitting rotation of said outer bolt portion to the unlocked position when said ratchet tooth is disengaged from said last mentioned means, by endwise movement of said inner bolt portion by said associated key or door knob as aforesaid.

7. The device according to claims 1, 2 or 3 which includes spring means extending between said outer bolt portion and said support means normally urging said outer bolt portion towards the unlocked position.

8. The device according to claims 4, 5 or 6 which includes spring means extending between said outer bolt portion and said support means normally urging said outer bolt portion towards the unlocked position.

* * * * *